US011033108B2

(12) United States Patent
Limingoja

(10) Patent No.: US 11,033,108 B2
(45) Date of Patent: Jun. 15, 2021

(54) SEAT BASE FOR A SADDLE SEAT

(71) Applicant: HUMANTOOL OY, Espoo (FI)

(72) Inventor: Antti Limingoja, Espoo (FI)

(73) Assignee: HUMANTOOL OY, Espoo (FI)

( * ) Notice: Subject to any disclaimer, the term of this patent is extended or adjusted under 35 U.S.C. 154(b) by 0 days.

(21) Appl. No.: 16/341,724

(22) PCT Filed: Oct. 12, 2017

(86) PCT No.: PCT/FI2017/050716
§ 371 (c)(1),
(2) Date: Apr. 12, 2019

(87) PCT Pub. No.: WO2018/069577
PCT Pub. Date: Apr. 19, 2018

(65) Prior Publication Data

US 2020/0046131 A1 Feb. 13, 2020

(30) Foreign Application Priority Data

Oct. 13, 2016 (FI) ..... 20165780

(51) Int. Cl.

| | |
|---|---|
| ***B60N 2/38*** | (2006.01) |
| ***A47C 3/02*** | (2006.01) |
| ***A47C 7/24*** | (2006.01) |
| ***A47C 9/00*** | (2006.01) |
| ***A47C 9/02*** | (2006.01) |
| ***A47C 7/02*** | (2006.01) |

(52) U.S. Cl.
CPC ..... *A47C 3/02* (2013.01); *A47C 7/021* (2013.01); *A47C 7/24* (2013.01); *A47C 9/002* (2013.01); *A47C 9/02* (2013.01)

(58) Field of Classification Search
CPC ..... A47C 3/027; A47C 3/02; A47C 7/021; A47C 7/24; A47C 7/029; A47C 9/002; A47C 9/02; A47C 7/002
USPC ..... 297/195.11, 195.1, 215.15, 215.16
See application file for complete search history.

(56) References Cited

U.S. PATENT DOCUMENTS 3,586,321 A * 6/1971 Gehrke ..... A63G 23/00 482/146
3,964,790 A * 6/1976 Bergeron ..... A47C 3/04 297/451.5

(Continued)

FOREIGN PATENT DOCUMENTS

CN 204032816 U 12/2014
CN 205625321 U 10/2016

(Continued)

OTHER PUBLICATIONS

International Search Report and Written Opinion issued in PCT/FI2017/050716, dated Jan. 11, 2018, 11 pages.

*Primary Examiner* — Chi Q Nguyen
(74) *Attorney, Agent, or Firm* — Eversheds Sutherland (US) LLP

(57) ABSTRACT

Systems and methods are disclosed for a seat base for a saddle seat. An example seat base may include a first face, the first face forming a planar surface to allow the seat base to be arranged on a surface to be seated, and a second face, the second face forming a concave surface, the concave surface restricting the lateral movement of the saddle seat by guiding the round lower part of the saddle seat towards the lowest point of the concave surface.

6 Claims, 3 Drawing Sheets

(56) References Cited

U.S. PATENT DOCUMENTS

| | | | | |
|---|---|---|---|---|
| 4,027,888 | A * | 6/1977 | Wilcox | A47C 3/16 297/452.17 |
| 9,320,940 | B2 * | 4/2016 | Rainey | A63B 22/16 |
| 9,420,890 | B2 * | 8/2016 | Lee | A47C 5/12 |
| 9,420,891 | B2 * | 8/2016 | Oh | B29C 44/1285 |
| 9,456,696 | B2 * | 10/2016 | Lee | A47C 7/46 |
| 9,737,751 | B2 * | 8/2017 | Anderson | A63B 21/16 |
| 9,788,659 | B1 * | 10/2017 | Jen | A47C 9/002 |
| 10,206,514 | B1 * | 2/2019 | Zivalich | A47C 9/002 |
| 2003/0195098 | A1 * | 10/2003 | Hsu | A47C 9/002 482/148 |
| 2008/0224521 | A1 * | 9/2008 | Topping | A47C 9/027 297/338 |
| 2009/0286656 | A1 * | 11/2009 | Okamoto | A63B 19/04 482/78 |
| 2011/0237412 | A1 * | 9/2011 | Signorile | A63B 26/003 482/142 |
| 2012/0068507 | A1 * | 3/2012 | Debevec | A47C 7/021 297/250.1 |
| 2014/0162858 | A1 * | 6/2014 | Dalebout | A63B 26/003 482/142 |
| 2015/0113735 | A1 * | 4/2015 | Anderson | A47C 7/021 5/654 |

FOREIGN PATENT DOCUMENTS

| | | | |
|---|---|---|---|
| DE | 202006015682 | U1 | 12/2006 |
| JP | 2010158329 | A | 7/2010 |

* cited by examiner

100

102

100

SEAT BASE FOR A SADDLE SEAT

CROSS-REFERENCE TO RELATED APPLICATIONS

This application is a national stage application, filed under 35 U.S.C. § 371, of International Application No. PCT/FI2017/050716, filed on Oct. 12, 2017, titled "Seat Base for a Saddle Seat," which claims priority to Finland Patent Application No. 20165780, filed on Oct. 13, 2016, the entire contents of each of which are hereby incorporated herein by reference in their entirety for all purposes.

TECHNICAL FIELD

The present invention relates to a seat base for a saddle seat.

BACKGROUND OF THE INVENTION

A major part of office work today involves static sitting in front of a monitor, for example. This almost inevitably results in ailments which could be prevented by suitable means. Often the problem is that people become overly absorbed in their work, staying almost still, which restricts the circulation of blood and other fluids, and, thereby, results in different kinds of ailments, pains and limitations.

It is recommended that people with sedentary jobs have exercise breaks at regular intervals. They could mostly take care of the problem in this way. But they neglect these exercise breaks and stretching, consequently getting caught in a vicious circle. In addition to neck and shoulder problems, lumbar problems are also common. The reason for this is obvious—the immobile sitting position restricts the fluid circulation and prevents the intervertebral discs of the spine joints from recovering from compression.

A cushion has been developed for flexing the lower parts of the back, in the hopes of solving these problems. The cushion is filled with a medium and it is believed that the person sitting thereon gets enough flexing by moving his/her weight from side to side. However, the movement provided by the cushion is insufficient, especially if it is supported on a soft chair, as it is in most cases.

Saddle seats have also been developed to assist in static sedentary work. A saddle called Humantool® is a saddle seat that can be fitted on a sittable support, such as a chair. However, the beneficial movement provided in the back region by the saddle seat becomes weaker on many sittable, especially soft, supports. Besides, on even supports, the saddle seat may be able to move laterally, possibly causing inconvenience to the person sitting thereon, reducing the effect of the saddle seat and, in the worst case, putting the person sitting thereon in danger.

SUMMARY OF THE INVENTION

The present invention aims at alleviating the above-mentioned problems related to ailments resulting from continuous prolonged static sedentary work. An objective of the invention is to improve the operating characteristics of the existing saddle seat. A second objective of the invention is to increase the mobility of the round lower part of the saddle seat, especially on soft supports. A third objective of the invention is to restrict the lateral movement of the saddle seat. A fourth objective of the invention is to enhance the safety of the saddle seat.

The objectives of the invention are achieved according to an aspect of a seat base for a saddle seat.

The seat base for a saddle seat according to the invention is characterized by what is set forth in the characterizing part of claim 1.

Preferred embodiments of the invention are also described in the dependent claims.

According to an aspect of the invention, a seat base for a saddle seat comprises

- a first face, the first face forming a planar surface to allow the seat base to be arranged on a surface to be seated, and
- a second face, the second face forming a concave surface, the concave surface restricting the lateral movement of the saddle seat by guiding the round lower part of the saddle seat towards the lowest point of the concave surface.

According to an embodiment of the invention, the seat base is circular in shape and the lowest point of the concave surface is the center of the seat base.

According to an embodiment of the invention, the second face is coated with a softer layer in order to improve the mobility of the saddle seat. According to an embodiment of the invention, the second face is coated with a layer of woven felt.

According to an embodiment of the invention, the first face comprises a number of circular reinforcements and/or a number of radial reinforcements, the reinforcements forming the first face and/or reinforcing the structure of the seat base.

According to an embodiment of the invention, a substantially vertical collar is provided at the upper edge of the second face, the collar ensuring that the saddle seats stays on the seat base.

According to an embodiment of the invention, the seat base for a saddle seat is made of plastic.

According to an embodiment of the invention, the first face comprises an even surface that preferably covers the entire bottom.

The utility of the seat base for a saddle seat according to the invention arises from a number of facts. The seat base according to an embodiment may increase the mobility of the saddle seat, especially on soft supports, such as soft chairs. The concave surface of the seat base according to an embodiment may return the saddle seat to the center of the seat base, preventing the saddle seat from sliding off the surface in use, which can be a chair, for example. The seat base according to an embodiment may increase the safety of use of the saddle seat. The seat base according to an embodiment may increase the rolling resistance of the round lower part of the saddle seat, as the round lower part is forced to climb up the concave surface, which may allow sitting comfortably. According to an embodiment of the seat base, the saddle seat can be apt to small movements, but its larger movements may be dampened, which may make it easier to control how the saddle seat moves.

In this application, the expression "a number of" refers to any positive integer, starting from one (1), such as one, two or three.

The term "a plurality of", in turn, refers to any integers starting from two (2).

In this application, the expression "seat base" refers to the solution according to the present invention.

The expression "surface to be seated", in turn, refers to the surface on which the present seat base can be placed, such as the seat of a chair.

BRIEF DESCRIPTION OF THE FIGURES

In the following, preferred embodiments of the invention will be described in more detail with reference to the accompanying figures wherein.

MORE DETAILED DESCRIPTION OF THE FIGURES

Figure 1:
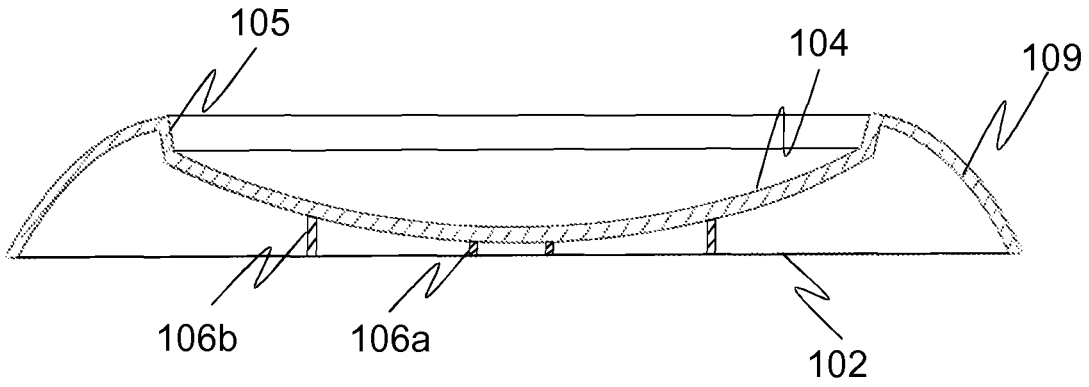
FIG. 1 is a cross-sectional view of a seat base according to an embodiment of the present invention.

FIG. 1 is a cross-sectional view of a seat base 100 according to an embodiment of the present invention. The seat base 100 comprises a first face 102 and a second face 104.

The first face 102 forms a planar surface against the surface to be seated. The surface to be seated can be the seat of a chair, for example (not shown in the Figure). The first face 102, i.e. the bottom of the seat base is placed against the surface to be seated. The second face 104 forms a concave surface. A substantially vertical collar 105 is provided at the upper edge of the second face 104.

Figure 2:
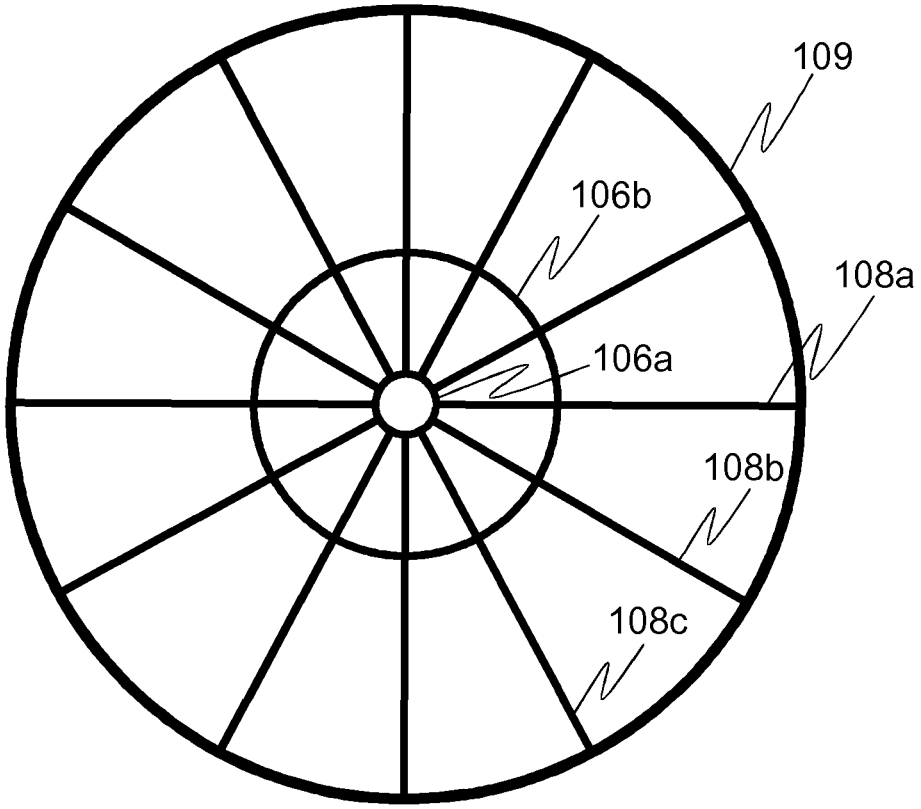
FIG. 2 is a bottom view of a seat base according to an embodiment of the present invention.

The first face 102 comprises a number of circular reinforcements 106*a*, 106*b*. Referring to FIG. 2, the first face 102 also comprises a number of radial reinforcements 108*a*, 108*b*, 108*c*. The reinforcements form the first face 102. Alternatively, in addition to or instead of the reinforcements, an even, sheet-like surface can be arranged on the first face 102, preferably covering the entire bottom. Most preferably, there are two circular reinforcements and 12 radial reinforcements. The radial reinforcements can be evenly distributed over the bottom of the seat base. The number of the reinforcements may vary depending on the embodiment. The seat base 100 comprises a curved rim 109 that joins the collar 105 and the first face 102 together. The rim 109 also forms the outermost circular reinforcement of the seat base. The radial reinforcements 108*a*, 108*b*, 108*c* are attached to the rim 109.

The seat base can be made from plastic or some other durable material, for example. The second face 104 of the seat base can be coated with a layer of a softer material, such as a layer of woven felt. The seat base 100 is preferably circular in shape. Alternatively, the shape of the seat base may vary, depending on the embodiment. The diameter of the circular seat base is preferably 10 to 50 cm, more preferably 20 to 40 cm and most preferably 25 to 35 cm.

Figure 3:
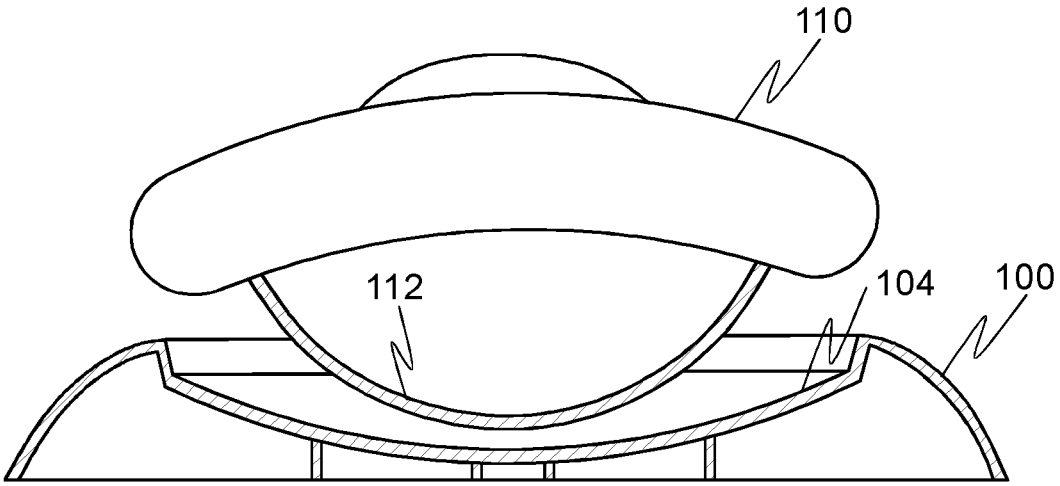
FIG. 3 is a cross-sectional view of a seat base according to an embodiment of the present invention, and a cross-sectional view of a saddle seat fitted on the seat base.

FIG. 3 is a cross-sectional view of a seat base 100 and a saddle seat 110 according to an embodiment. The saddle seat 110 shown is a Humantool® saddle, for example. The saddle seat 110 comprises a round, swing-enabling lower part 112. The lower part 112 of the saddle seat is arranged on the second face 104 of the seat base 100.

Figure 4:
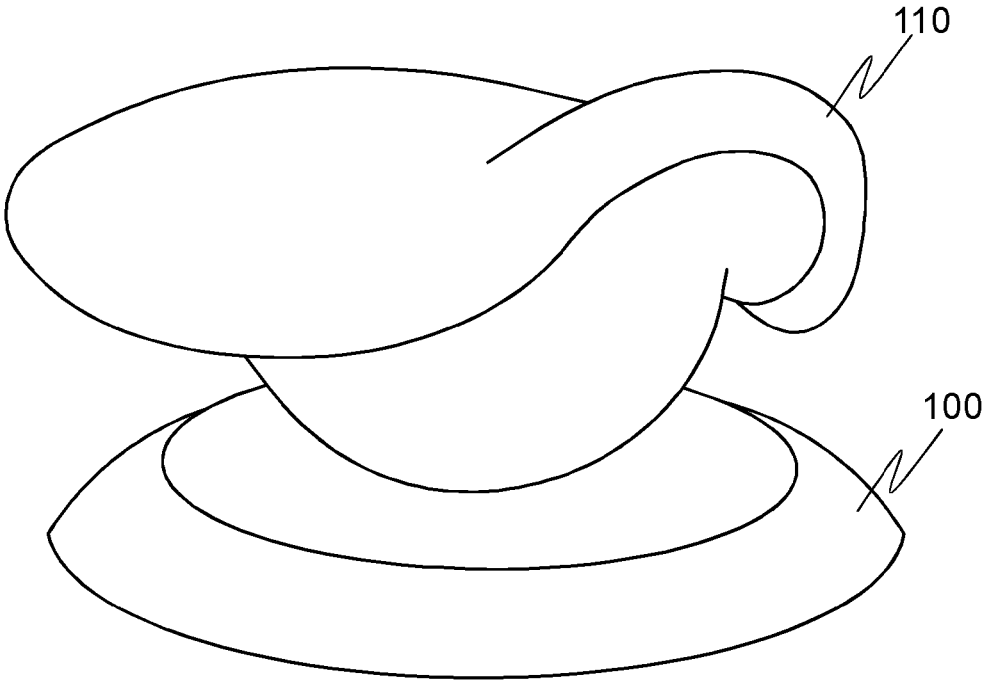
FIG. 4 shows an axonometric projection of a seat base according to an embodiment of the present invention, and of a saddle seat fitted on the seat base.
Figure 5:
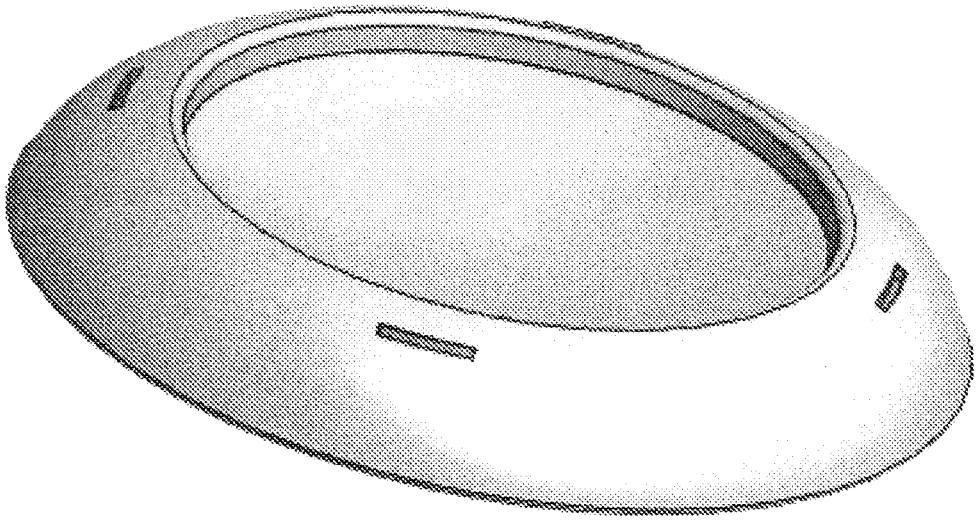
FIG. 5 shows an axonometric projection of a seat base according to an embodiment of the present invention.

FIG. 4 shows an axonometric projection of a seat base 100 and a saddle seat 110. Further, FIG. 5 shows an axonometric projection of a seat base according to an embodiment of the present invention.

The scope of the invention is defined by the accompanying claims. However, it is obvious for a person skilled in the art that the details of the different features of the invention may vary to some extent within the overall inventive idea, depending on the embodiment of the invention.

The invention claimed is:

1. A seat base for a saddle seat, comprising:

a first face, the first face forming a planar surface to allow the seat base to be arranged on a surface to be seated, and a second face, the second face forming a spherical concave surface, the concave surface configured to guide a round lower part of the saddle seat towards a lowest point of the concave surface, wherein the second face is coated with a layer that is softer than the first face, in order to improve a mobility of the saddle seat on the seat base.

2. A seat base as defined in claim 1, wherein the layer comprises a layer of woven felt.

3. A seat base as defined in claim 1, wherein the first face comprises at least one of circular reinforcement or radial reinforcement, the at least one of circular reinforcement or radial reinforcement forming the first face and reinforcing a structure of the seat base.

4. A seat base as defined in claim 1, further comprising: a substantially vertical collar that is provided at an upper edge of the second face, the substantially vertical collar ensuring that the saddle seat stays on the seat base.

5. A seat base as defined in claim 1, wherein the seat base is made of plastic.

6. A seat base as defined in claim 1, wherein the first face comprises an even surface that covers an entire first face.

* * * * *